United States Patent [19]

Winchell et al.

[11] 4,177,905

[45] Dec. 11, 1979

[54] CLOSURE SYSTEM FOR CONTAINERS

[75] Inventors: David A. Winchell, Twin Lakes, Wis.; Thomas A. Fowles, McHenry, Ill.

[73] Assignee: Baxter Travenol Laboratories, Inc., Deerfield, Ill.

[21] Appl. No.: 912,670

[22] Filed: Jun. 5, 1978

[51] Int. Cl.[2] ..... B65D 41/54

[52] U.S. Cl. ..... 215/246; 215/329; 215/341

[58] Field of Search ..... 215/246, 329, 341, 254, 215/352, 354, 252

[56] References Cited

U.S. PATENT DOCUMENTS

| | | | |
|---|---|---|---|
| 2,311,983 | 2/1943 | Gora | 215/352 |
| 2,339,702 | 1/1944 | Isele | 215/354 |
| 3,227,302 | 1/1966 | Merrill | 215/352 |
| 3,480,169 | 11/1969 | Hammes | 215/354 |
| 3,615,714 | 10/1971 | Nelson | 215/252 |
| 4,000,824 | 1/1977 | Han | 215/246 |

*Primary Examiner*—Ro E. Hart

*Attorney, Agent, or Firm*—Paul C. Flattery; John P. Kirby, Jr.; George Gerstman

[57] ABSTRACT

A closure system is provided for a threaded container. A threaded closure cap has an annular skirt which engages a resilient gasket that is stretched over the bottle neck. The resilient gasket overlies a cap support flange which extends from the neck. Downward axial movement of the cap with respect to the container provides a vertical compressive force against the resilient gasket by the cap skirt. A heat shrinkable outer member surrounds the closure cap and provides a tamperproof seal with respect to the container.

20 Claims, 4 Drawing Figures

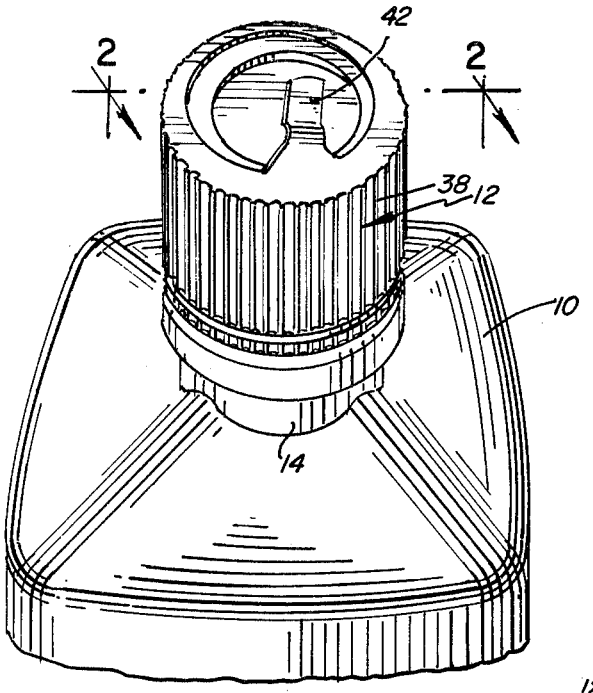
FIG. 1
FIG. 3
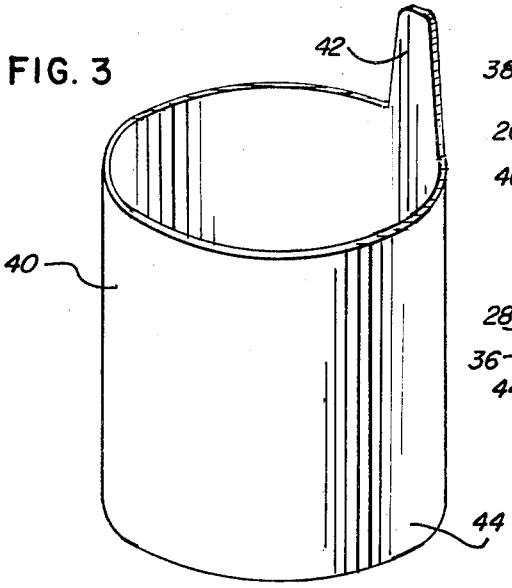
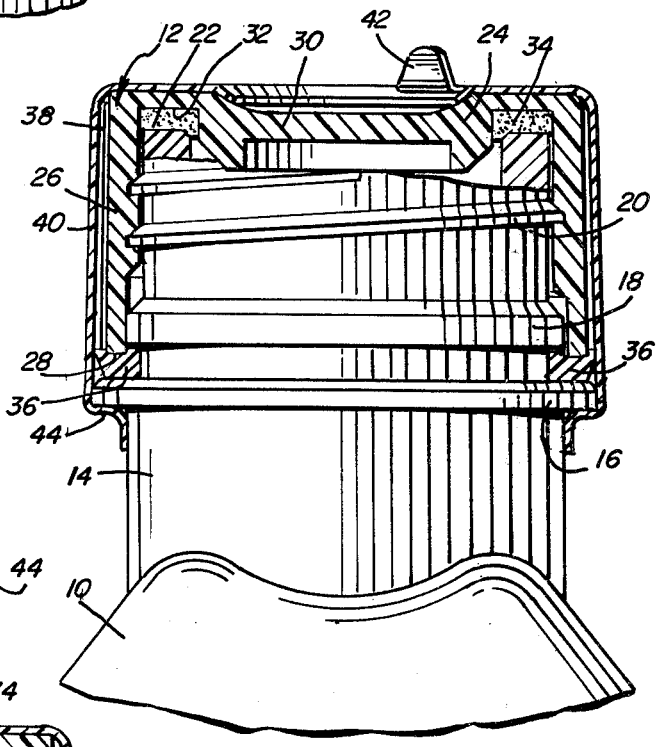
FIG. 2
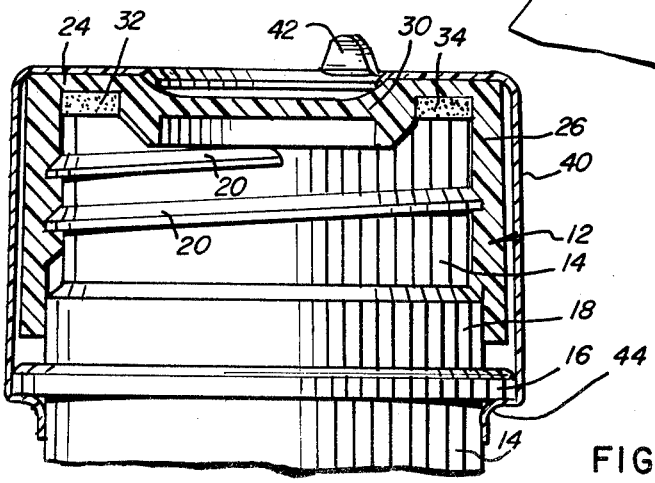
FIG. 4

CLOSURE SYSTEM FOR CONTAINERS

BACKGROUND OF THE INVENTION

The present invention concerns an improved closure system for a container.

Medical containers are preferably hermetically sealed and often the solutions must be sterilized while in the container. One type of prior art closure for a medical container utilizes an aluminum screw cap as a primary container closure with a plastic overcap. Plastic caps which have been used in the medical field for sterilized liquids have generally been complex and expensive.

It is an object of the invention to provide a closure cap that is relatively simple in construction and easy to manufacture.

Another object of the present invention is to provide a threaded closure cap that is formed as a single molded member.

A further object of the present invention is to provide a closure system including a threaded overcap which is relatively simple in construction and contains an effective and secure sealing means.

A still further object of the invention is to provide a closure system in which a simple threaded closure cap is hermetically sealed by an inexpensive outer seal member.

Another object of the invention is to provide a closure system for a medical container, which closure system and container are formed of drug-compatible autoclavable material.

Other objects and advantages of the present invention will become apparent as the description proceeds. It is to be understood, however, that the present invention is not limited to the field of medical containers and may be applied to containers used in other fields and formed of various materials.

BRIEF DESCRIPTION OF THE INVENTION

In accordance with the present invention, a closure system is provided for a container having a neck with a cap support flange extending radially outwardly from the neck. The top of the neck comprises a pour lip and the neck has threads above the support flange for engaging cooperating threads carried by a closure cap.

The improvement comprises a closure cap comprising a top portion and an annular skirt depending downwardly therefrom. The closure cap carries threads adapted to cooperate with the container neck threads to enable axial travel of the cap with respect to the container neck when the cap is rotated with respect to the container neck.

A substantially circular central member depends downwardly from the closure cap top portion. The outer diameter of the central member is smaller than the internal diameter of the pour lip. A first resilient gasket tightly encircles the central member and is positioned for vertical compression by the pour lip. A second resilient gasket tightly encircles the neck and overlies the cap support flange. The second resilient gasket is located to directly underlie the bottom of the annular skirt, whereby downward axial movement of the cap with respect to the container neck will provide a vertical compressive force against the second resilient gasket by the cap skirt.

In the illustrative embodiment, the container is a medical container and the container, closure cap and resilient gaskets are formed of drug-compatible autoclavable material.

In the illustrative embodiment, the second resilient gasket tightly surrounds the neck and has substantial inward radial forces against the neck whereby spreading of the gasket will be alleviated when the cap is moved downwardly into engagement with the gasket.

In the illustrative embodiment, the threads are substantially non-round to alleviate radial outward vector forces on the cap and to enhance the vertical compressive forces by the cap on the second gasket. An outer member surrounds the closure cap and provides a tamperproof and dust-free seal.

In the illustrative embodiment, the outer member comprises an endless band formed of heat shrinkable material. The band is heat shrunk around the closure cap and includes means for tearing the band away from the closure cap.

A more detailed explanation of the invention is provided in the following description and claims, and is illustrated in the accompanying drawings.

BRIEF DESCRIPTION OF THE DRAWINGS

FIG. 1 is a perspective view of a closure system for a container, constructed in accordance with the principles of the present invention;

FIG. 2 is a cross-sectional view thereof, taken along the plane of the line 2—2 of FIG. 1;

FIG. 3 is a perspective view of the outer member of the closure system of FIGS. 1 and 2, prior to its connection to the container; and FIG. 4 is a cross-sectional view of a modified form of the present invention.

DETAILED DESCRIPTION OF THE ILLUSTRATIVE EMBODIMENT

Referring to the drawings, the closure system of the present invention is used in connection with a medical container 10, preferably formed of a polypropylene copolymer that is sterilizable. The closure system comprises a plastic screw-on type cap which is in threaded engagement with the neck 14 of container 10. Container 10 includes a cap support flange 16 which extends radially outwardly from neck 14 and a second flange 18 which is axially spaced from flange 16 and extends radially outwardly from neck 14. Neck 14 also carries threads 20 which are non-round in configuration, as will be discussed in more detail below. The top 22 of neck 14 comprises a pour lip and the container neck with its associated flanges and threads is preferably circular in cross-sectional configuration and formed as a one-piece molded construction, such as by blow molding.

Plastic cap 12 is also preferably formed of a polypropylene copolymer that is sterilizable. Cap 12 has a top portion 24 and an annular skirt 26 which depends downwardly from top portion 24 to terminate at a bottom end 28. Skirt 26 is internally threaded to receive the external threads 20 of container 10.

Top portion 24 includes a circular central member or boss 30 which depends downwardly from the top portion, as illustrated most clearly in FIG. 2. The outer diameter of the central member 30 is smaller than the internal diameter of pour lip 22, thereby providing an annular groove 32 into which the pour lip 22 may extend during downwardly travel of the closure cap.

A first reslient gasket 34 is stretched over central member 30 to tightly encircle central member 30 and be received within annular groove 32. During downward travel of the closure cap on the container neck, the pour lip 22 will provide a vertical compressive force against gasket 34, thereby forming a fluid seal, as illustrated in FIG. 2.

A second resilient gasket 36 is tightly stretched over flange 18 and around neck 14 to surround neck 14. By using a gasket 36 which is tightly stretched around neck 14, there are substantial inward radial forces provided by the gasket against the neck. As illustrated in FIG. 2, gasket 36 directly underlies bottom 28 of skirt 26 and thus downward axial movement of cap 26 with respect to container neck 14 will provide a vertical compressive force against gasket 36. The inward radial forces against the neck provided by the gasket will alleviate spreading of the gasket notwithstanding the vertical compressive forces provided by bottom 28 of cap 12 against the gasket. In addition, gasket 36 need not be perfectly circular because the stretching of the gasket will force it against neck 14 and the gasket will operate to encircle the neck notwithstanding variations in the circularity of the gasket.

It is preferred that gaskets 34 and 36 be formed of silicone rubber, although other materials may be found suitable.

As stated above, the threads 20 are non-round or rectangularly oriented in cross-section. In this manner, radial outward vector forces on the cap 12 caused by the threads are alleviated, because the threads are relatively flattened so that the forces provided by the threads against cap 12 are substantially vertical. This enhances the vertical compression on gasket 36 caused by skirt 26. By utilizing a vertical compressive force upon gasket 36 by cap skirt, a type of knife-edge contact is achieved thereby providing an excellent seal. This is also achieved with less surface contact between the cap and the gasket, which less surface contact provides substantial compression with a minimum amount of torque.

Thus cap 12 is screwed onto bottle neck 14. As the cap travels downward on the neck, gasket 34 engages pour lip 22. Thereafter, bottom 28 of skirt 26 engages gasket 36. Continued rotation of the cap downwardly will compress both gaskets 34 and 36 providing double seal protection for the contents of the container.

In the illustrative embodiment, cap 12 comprises a plurality of spaced vertical ribs 38, enabling superior manual frictional contact with the cap.

Referring to FIG. 3, an outer member 40 which is formed of a heat shrinkable plastic material and is generally cylindrical in construction, is provided for dust-sealing the system and for providing a tamperproof seal. Outer member 40 is preferably formed of PVC and is autoclavable. Although no limitation is intended, as an example, the outer member 40 could be 0.006 inch in thickness.

Outer member 40 includes a manually-graspable tab portion 42 which extends upwardly from the main portion of outer member 40, which is preferably formed as an endless band. In connecting outer member 40 to the container, after the cap 12 is connected the outer member 40 is slid over the cap and heat shrunk to form the seal illustrated in FIGS. 1 and 2. It can be seen that the upper portion of the band forming outer member 40 overlies the top portion 24 of cap 12 and the lower portion 44 of outer member 40 forms a seal between flange 16 and neck 14, as illustrated in FIG. 2.

In order to remove outer member 40, tab portion 42 is grasped and pulled so that the band forming outer member 40 will be torn. Once torn, there is an irreversible indication of tampering.

Outer member 40 is also shown in connection with the FIG. 4 embodiment. In the FIG. 4 embodiment, the container neck and closure cap structure is similar to that illustrated in FIG. 2, but only upper gasket 34 is utilized. The FIG. 4 embodiment can be used to provide a less expensive construction than the FIG. 2 embodiment when the sealing requirements are less.

It is seen that a closure system has been provided which is simple in construction and easy to manufacture, and includes relatively few parts, all of which are autoclavable, if desired. Although two embodiments of the invention have been shown and described, it is to be understood that various modifications and substitutions may be made by those skilled in the art without departing from the novel spirit and scope of the present invention.

What is claimed is:

1. A closure system for a container having a neck with a cap support flange extending radially outwardly from the neck, the top of the neck comprising a pour lip, the neck having threads above the support flange for engaging cooperating threads carried by a closure cap, the improvement comprising, in combination:

a closure cap comprising a top portion and an annular skirt depending downwardly therefrom;

said closure cap carrying threads adapted to cooperate with the container neck threads to enable axial travel of the cap with respect to the container neck when the cap is rotated with respect to the container neck;

a substantially circular central member depending downwardly from said closure cap top portion, the outer diameter of said central member being smaller than the internal diameter of the pour lip;

a first resilient gasket tightly encircling said central member and being positioned for vertical compression by the pour lip; and a second resilient gasket tightly encircling said neck and overlying said cap support flange, said second resilient gasket being located to directly underlie the bottom of said annular skirt whereby downward axial movement of the cap with respect to the container neck will provide a vertical compressive force against said second resilient gasket by said cap skirt.

2. A closure system as described in claim 1, wherein the container is a medical container and said container, closure cap and resilient gaskets are formed of drug-compatible autoclavable material.

3. A closure system as described in claim 2, wherein said resilient gaskets are formed of silicone rubber.

4. A closure system as described in claim 1, including a second flange axially spaced from said cap support flange and extending radially outwardly from the neck, said second gasket being interposed on the neck between said cap support flange and said second flange.

5. A closure system as described in claim 1, said second resilient gasket tightly surrounding said neck and having substantial inward radial forces against the neck whereby spreading of the gasket will be alleviated when the cap is moved downwardly into engagement with the gasket.

6. A closure system as described in claim 1, wherein the threads are substantially non-round to alleviate radial outward vector forces on the cap and to enhance the vertical compressive forces by the cap on the second gasket.

7. A closure system as described in claim 1, including an outer member surrounding the closure cap and sealing the cap skirt with respect to the container.

8. A closure system as described in claim 7, said outer member comprising an endless band formed of heat shrinkable material, said band being heat shrunk around the closure cap and including means for tearing the band away from the closure cap.

9. A closure system as described in claim 8, said tearing means comprising a manually-graspable tab portion extending upwardly from the main portion of the band with said tab portion overlying the top portion of the closure cap when the band is in place on the cap.

10. A closure system as described in claim 8, said head shrink band being formed of PVC.

11. A closure system for a container having a neck with a cap support flange extending radially outwardly from the neck, the top of the neck comprising a pour lip, the neck having threads above the support flange for engaging cooperating threads carried by a closure cap, the improvement comprising:

a closure cap comprising a top portion and an annular skirt portion depending downwardly therefrom;

said closure cap carrying threads adapted to cooperate with the container neck threads to enable axial travel of the cap with respect to the container neck when the cap is rotated with respect to the container neck;

a substantially circular central member depending downwardly from said closure cap top portion, the outer diameter of said central member being smaller than the internal diameter of the pour lip;

a first resilient gasket tightly encircling said central member and being positioned for vertical compression by the pour lip;

a second resilient gasket tightly encircling said neck and overlying said cap support flange;

said second resilient gasket being located to directly underlie the bottom of said annular skirt whereby downward axial movement of the cap with respect to the container neck will provide a vertical compressive force against said second resilient gasket by said cap skirt;

said second resilient gasket tightly surrounding said neck and having substantial inward radial forces against the neck whereby spreading of the gasket will be alleviated when the cap is moved downwardly into engagement with the gasket; and wherein the threads carried by said closure cap are substantially non-round to alleviate radial outward vector forces on the cap and to enhance the vertical compressive forces by the cap on the second gasket.

12. A closure system as described in claim 11, wherein the container is a medical container and said container, closure cap and resilient gaskets are formed of drug-compatible autoclavable material.

13. A closure system as described in claim 11, including a second flange axially spaced from said cap suppot flange and extending radially outwardly from the neck, said second gasket being interposed on the neck between said cap support flange and said second flange.

14. A closure system for a plastic medical container formed of drug-compatible autoclavable material, which container has a neck with a cap support flange extending radially outwardly from the neck, the top of the neck comprising a pour lip, the neck having threads above the support flange for engaging cooperating threads carried by a closure cap, the improvement comprising, in combination:

a plastic closure cap formed of drug-compatible autoclavable material and comprising a top portion and an annular skirt depending downwardly therefrom;

said closure cap carrying threads adapted to cooperate with the container neck theads to enable axial travel of the cap with respect to the container neck when the cap is rotated with respect to the container neck;

a substantially circular central member depending downwardly from said closure cap top portion, the outer diameter of the said central member being smaller than the internal diameter of the pour lip;

a first resilient gasket tightly encircling said central member and being positioned for vertical compression by the pour lip, said resilent gasket being formed of silicone rubber;

a second resilient gasket tightly encircling said neck and overlying said cap support flange, said second resilient gasket being located to directly underlie the bottom of said annular skirt whereby downward axial movement of the cap with respect to the container neck will provide a vertical compressive force against said second resilient gasket by said cap skirt;

said second resilient gasket being formed of silicone rubber;

said second gasket tightly surrounding said neck and having substantial inward radial forces against the neck whereby spreading of the gasket will be alleviated when the cap is moved downwardly into engagement with the gasket;

said threads being substantially non-round to alleviate radial outward vector forces on the cap and to enhance the vertical compressive forces by the cap on the second gasket;

an outer member surrounding the closure cap and sealing the cap skirt with respect to the container, said outer member comprising an endless band formed of heat shrinkable material, said band being heat shrunk around the closure cap and including means for tearing the band away from the closure cap; and said tearing means comprising a manually-graspable tab portion extending upwardly from the main portion of the band with said tab portion overlying the top portion of the closure cap when the band is in place on the cap.

15. A closure system as described in claim 14, wherein said heat shrink band is formed of PVC.

16. A closure system for a plastic medical container formed of drug-compatible autoclavable material, which container has a neck with a cap support flange extending radially outwardly from the neck, the top of the neck comprising a pour lip, the neck having threads above the support flange for engaging cooperating threads carried by a closure cap, the improvement comprising, in combination:

a plastic closure cap comprising a top portion and an annular skirt depending downwardly therefrom;

said closure cap carrying threads adapted to cooperate with the container neck threads to enable axial travel of the cap with respect to the container neck when the cap is rotated with respect to the container neck;

a substantially circular central member depending downwardly from said closure cap top portion, the outer diameter of said central member being smaller than the internal diameter of the pour lip;

a resilient gasket tightly encircling said central member and being positioned for vertical compression by the pour lip; and an outer member surrounding the closure cap and sealing the cap skirt with respect to the container, said outer member comprising an endless band formed of heat shrinkable material, said band being heat shrunk around the closure cap and including means for tearing the band away from the closure cap.

17. A closure system as described in claim 16, said tearing means comprising a manually-graspable tab portion extending upwardly from the main portion of the band with said tab portion overlying the top portion of the closure cap when the band is in place on the cap.

18. A closure system as described in claim 16, wherein said heat shrink band is formed of PVC.

19. A tamperproof closure system for a container which has a neck, the top of the neck comprising a pour lip, the neck having threads for engaging cooperating threads carried by a closure cap, the improvement comprising, in combination:

a closure cap comprising a top portion and an annular skirt depending downwardly therefrom;

said closure cap carrying threads adapted to cooperate with the container neck threads to enable axial travel of the cap with respect to the container neck when the cap is rotated with respect to the container neck;

an outer member surrounding the closure cap and sealing the cap skirt with respect to the container, said outer member comprising an endless band formed of heat shrinkable material, said band being heat shrunk around the closure cap and including means for tearing the band away from the closure cap, said tearing means comprising a manually graspable tab portion extending upwardly from the main portion of the band with said tab portion overlying the top portion of the closure cap when the band is in place on the cap.

20. A tamperproof closure system as described in claim 19, wherein said heat shrink band is formed of PVC.

* * * * *